US010081184B2

(12) United States Patent
Akama et al.

(10) Patent No.: US 10,081,184 B2
(45) Date of Patent: Sep. 25, 2018

(54) LIQUID DISCHARGE HEAD

(71) Applicant: CANON KABUSHIKI KAISHA, Tokyo (JP)

(72) Inventors: Yuichiro Akama, Tokyo (JP); Yuji Tamaru, Yokohama (JP); Naoko Tsujiuchi, Kawasaki (JP); Sayaka Seki, Tokyo (JP); Yasuaki Kitayama, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/647,023

(22) Filed: Jul. 11, 2017

(65) Prior Publication Data

US 2018/0029363 A1 Feb. 1, 2018

(30) Foreign Application Priority Data

Jul. 28, 2016 (JP) ..... 2016-148634

(51) Int. Cl.
*B41J 2/175* (2006.01)
*B41J 2/14* (2006.01)

(52) U.S. Cl.
CPC ..... *B41J 2/1433* (2013.01); *B41J 2/17523* (2013.01); *B41J 2/17533* (2013.01); *B41J 2/17536* (2013.01)

(58) Field of Classification Search
CPC .. B41J 2/1433; B41J 2/17559; B41J 2/17523; B41J 2/1752; B41J 2/1754; B41J 2/17553
See application file for complete search history.

(56) References Cited

U.S. PATENT DOCUMENTS 9,283,754 B2 * 3/2016 Iwakura ..... B41J 2/14
2006/0181571 A1 * 8/2006 Iijima ..... B41J 29/15 347/40
2007/0224874 A1 * 9/2007 Fukumasu ..... B41J 2/1752 439/409
2008/0024542 A1 * 1/2008 Miyazaki ..... B41J 2/14072 347/20

FOREIGN PATENT DOCUMENTS

JP 4683619 B2 5/2011

* cited by examiner

*Primary Examiner* — Juanita D Jackson
(74) *Attorney, Agent, or Firm* — Canon U.S.A., Inc. IP Division

(57) ABSTRACT

A liquid discharge head includes a recording element substrate for discharging a liquid and a housing with the recording element substrate attached thereto. A plurality of holes having openings on a back side of an attachment surface of the housing to be attached to the carriage, are juxtaposed in a direction intersecting with a vertical direction in a state where the liquid discharge head is attached to the carriage. Two positioning bosses, on the attachment surface, are formed above two holes at both end sides of a plurality of the juxtaposed holes or above portions on an inner side than the two holes, and configured to contact the carriage to determine a position of the liquid discharge head on the carriage.

7 Claims, 5 Drawing Sheets

LIQUID DISCHARGE HEAD

BACKGROUND OF THE INVENTION

Field of the Invention

The disclosure relates to a liquid discharge head for discharging a liquid.

Description of the Related Art

Generally, a liquid discharge head for discharging a liquid includes a recording element substrate for discharging a liquid, tanks for storing the liquid, and a housing in which flow paths for supplying the liquid from the tanks to the recording element substrate are formed. Such a liquid discharge head is attached to a carriage provided in a liquid discharge apparatus. For example, the carriage is provided with a lever for attaching and fixing the liquid discharge head. The liquid discharge head can be attached to the carriage by using the lever (refer to Japanese Patent No. 4683619).

In recent years, along with reduction of a size of liquid discharge apparatuses, a size of liquid discharge heads has been also reduced. Generally, the rigidity of a liquid discharge head increases as the size of the liquid discharge head decreases. Accordingly, it may become difficult to perform positioning of the liquid discharge head on the carriage, or the carriage may be deformed by the liquid discharge head when attaching the liquid discharge head to the carriage. If the position of the liquid discharge head on the carriage shifts or if the carriage is deformed, the positional accuracy of the liquid discharge head may be adversely affected, possibly resulting in a deviation of the liquid impact position from a desired position on a recording medium. Therefore, for example, in a case where the liquid discharge apparatus is a recording apparatus such as an ink jet printer, the printing quality of a recorded image may possibly be degraded.

The carriage can be prevented from being deformed by increasing the rigidity of the carriage. In this case, however, it is necessary to use a highly rigid material for the carriage or increase the thickness of the carriage, and a problem of an increase in cost and size of the carriage arises.

SUMMARY OF THE INVENTION

The disclosure is directed to offering a liquid discharge head which can be easily fixed to a carriage.

According to an aspect of the disclosure, a liquid discharge head having a recording element substrate for discharging a liquid and a housing with the recording element substrate attached thereto, which is attached to a carriage of a liquid discharge apparatus includes a plurality of holes having openings on a back side of an attachment surface of the housing to be attached to the carriage, juxtaposed in a direction intersecting with a vertical direction in a state where the liquid discharge head is attached to the carriage, and two first abutting portions, on the attachment surface, formed above two holes at both end sides of a plurality of the juxtaposed holes in the attachment state, or above portions more on an inner side than the two holes in the intersecting direction in the attachment state, and configured to contact the carriage to determine a position of the liquid discharge head on the carriage.

Further features and aspects of the disclosure will become apparent from the following description of numerous example embodiments with reference to the attached drawings.

DESCRIPTION OF THE EMBODIMENTS

Figure 1:
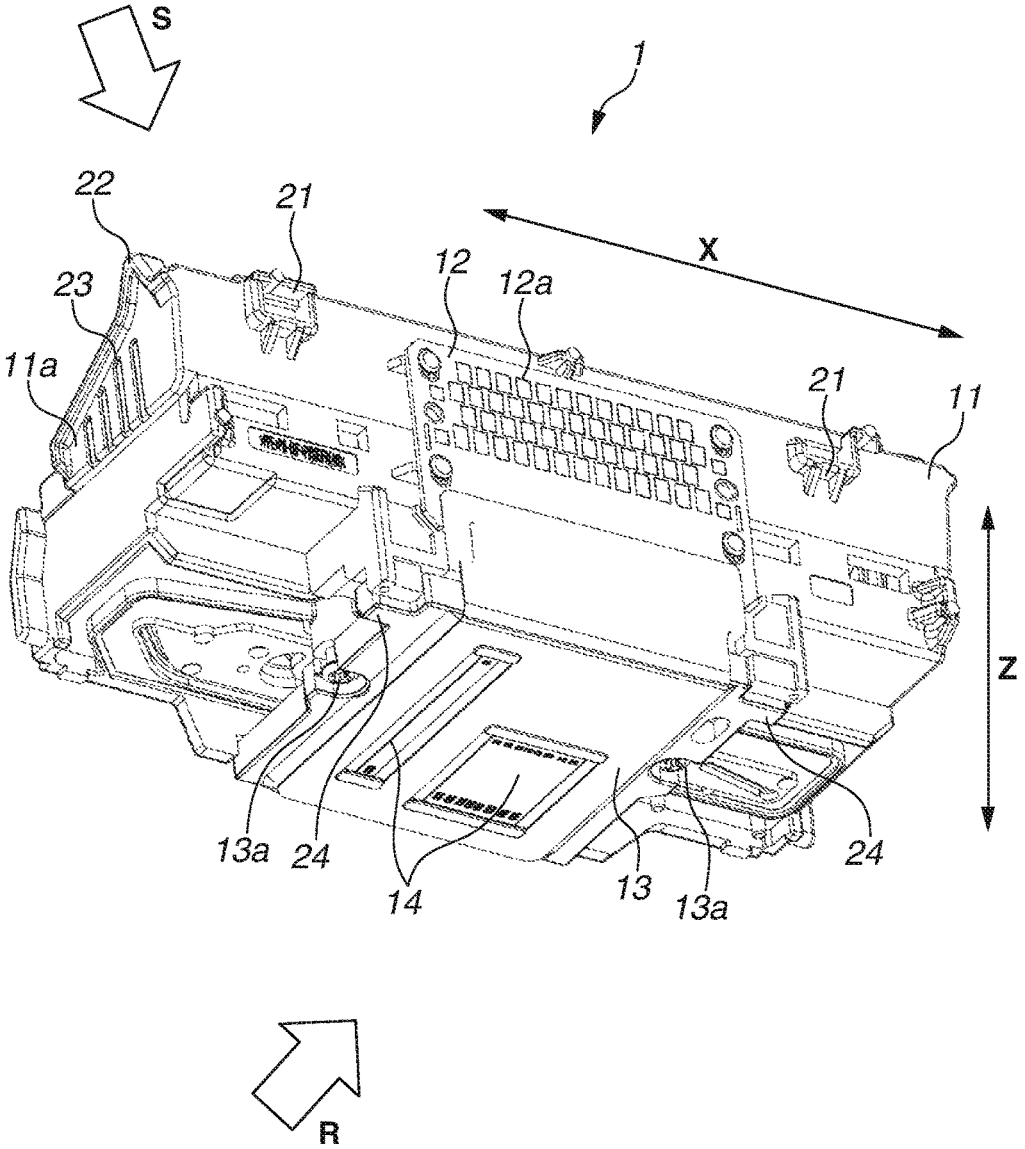
FIG. 1 is a perspective view schematically illustrating a liquid discharge head according to an example embodiment of the disclosure.

Example embodiments of the disclosure will now herein be described below with reference to the accompanying drawings. In each drawing, elements having the same function are assigned the same reference numeral and redundant descriptions thereof will be omitted.

(1. Head Configuration)

Figure 2:
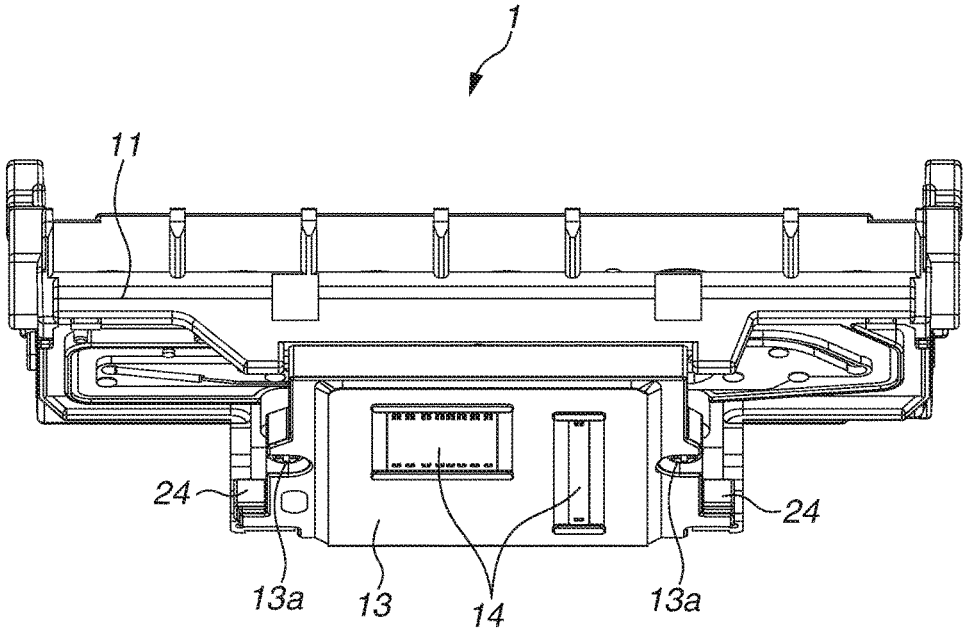
FIG. 2 is another perspective view schematically illustrating the liquid discharge head according to an example embodiment of the disclosure.

FIG. 1 is a perspective view schematically illustrating a liquid discharge head according to an example embodiment of the disclosure. FIG. 2 is another perspective view schematically illustrating the liquid discharge head viewed from the R direction illustrated in FIG. 1. A liquid discharge head 1 illustrated in FIGS. 1 and 2 is attached to a carriage (not illustrated) included in a liquid discharge apparatus (not illustrated). The liquid discharge apparatus according to the present example embodiment is a recording apparatus for recording an image by discharging a liquid, such as an ink-jet printer. The carriage can slide on a rail (not illustrated) disposed along the main scanning direction to reciprocally move in the main scanning direction. In a recording operation, the liquid discharge apparatus discharges a liquid from the liquid discharge head 1 while reciprocally moving the carriage. Then, in synchronization with the discharge of the liquid, the liquid discharge apparatus records an image on a recording medium by intermittently moving a recording medium (not illustrated) in the direction perpendicularly intersecting with the main scanning direction. The carriage reciprocally moves in the main scanning direction. In the example illustrated in FIG. 1, the main scanning direction when the liquid discharge head 1 is attached to the carriage is an X direction and the vertical direction is a Z direction. The X direction intersects with (desirably perpendicularly intersects with) the Z direction. Hereinafter, the upward and downward directions indicate the upward and downward directions in a state where the liquid discharge head 1 is attached to the carriage.

The liquid discharge head 1 includes a housing 11, an electric connection substrate 12, an electric wiring substrate 13, and a recording element substrate 14.

The housing 11 is formed of a resin. The upper part of the housing 11 is provided with two positioning bosses 21 as first abutting portions disposed in the X direction. When attaching the liquid discharge head 1 to the carriage, the positioning bosses 21 contact the carriage to determine the position of the liquid discharge head 1 on the carriage. The housing 11 is also provided with ribs 22 formed as pressed portions. When attaching the liquid discharge head 1 to the carriage, levers come into contact with the ribs 22 as pressing members for pressing the liquid discharge head 1 onto the carriage. A rib 22 is formed on each of the upper sides of side walls 11*a* on both sides of the housing 11 in the X direction, and is connected with each of the side walls 11*a*. Each of the side walls 11*a* is provided with a plurality of concave portions 23 which are juxtaposed. The positioning bosses 21 are formed more on the inner side of the housing 11 than the ribs 22 in the X direction.

The electric connection substrate 12 is attached to the housing 11. The surface of the housing 11 to which the electric connection substrate 12 is attached is the surface to be attached to the carriage. The electric connection substrate 12 is provided with a plurality of contact pads 12*a* for inputting electric signals from the liquid discharge apparatus. The electric signals include power used for discharging a liquid and logic signals for controlling the discharge of the liquid. The carriage of the liquid discharge apparatus is provided with a carriage substrate (not illustrated) having a plurality of contact pins (not illustrated) for connecting with the contact pads 12*a*. The contact pins having elasticity fit into the contact pads 12*a* with a pressure when attaching the liquid discharge head 1 to the carriage. Thus, the carriage and the electric connection substrate 12 are electrically connected.

The electric wiring substrate 13 having flexibility is bent to the housing 11, attached over the attachment surface and an undersurface, and fixed to the housing 11 with screws 13*a*. The housing 11 is provided with positioning surfaces 24 near both ends of the electric wiring substrate 13 in the X direction. The positioning surfaces 24 are formed to sandwich the electric wiring substrate 13. When attaching the liquid discharge head 1 to the carriage, the positioning surfaces 24 as second abutting portions contact the carriage to determine the position of the liquid discharge head 1 on the carriage. The positioning surfaces 24 are disposed more on the inner side of the housing 11 than the positioning bosses 21 in the X direction. The positioning surfaces 24 are disposed below the positioning bosses 21 in the attachment state, more specifically, disposed at positions closer to the recording element substrate 14 than to the positioning bosses 21.

The recording element substrate 14 is attached to the electric wiring substrate 13. The electric wiring substrate 13 electrically connects the electric connection substrate 12 with the recording element substrate 14, and supplies electric signals input to the electric connection substrate 12 to the recording element substrate 14.

The recording element substrate 14 includes a discharge port array composed of a plurality of discharge ports (not illustrated) for discharging a liquid, and discharges the liquid from each discharge port. The discharge port array is formed to be extendable in the direction perpendicularly intersecting with the X direction when the liquid discharge head 1 is attached to the carriage.

The recording element substrate 14 is connected with tanks (not illustrated) for storing a liquid, and discharges the liquid from the tanks out of the discharge ports based on electric signals from the electric connection substrate 12. According to the present example embodiment, the tanks are attached to the housing 11 which includes flow paths (not illustrated) for supplying the liquid stored in the tanks to the recording element substrate 14. To prevent air precipitation in the liquid flowing through the flow paths, it is desirable to add a filler (for example, a glass filler) of 30 percent or more to the resin forming the housing 11 to improve the gas barrier property. In this case, the frequency of a suction recovery operation for sucking the liquid from the liquid discharge head 1 can be reduced. Further, the rigidity of the housing 11 can be improved by adding a filler.

Figure 3:
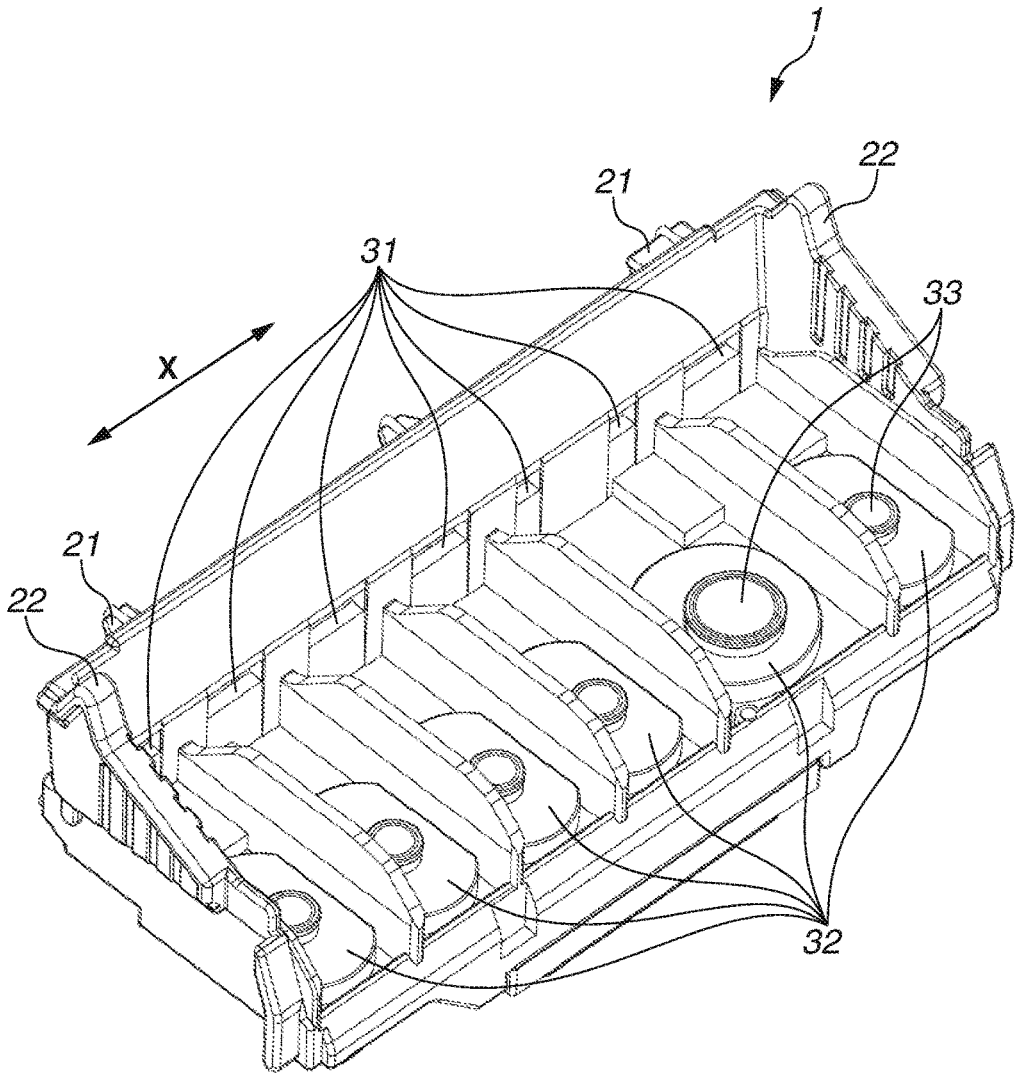
FIG. 3 is yet another perspective view schematically illustrating the liquid discharge head according to an example embodiment of the disclosure.

FIG. 3 is a perspective view schematically illustrating the liquid discharge head 1 when viewed from the S direction illustrated in FIG. 1. As illustrated in FIG. 3, the back side of the attachment surface of the housing 11 is provided with a plurality of engaging holes 31 juxtaposed in the X direction for attaching the tanks. While the number of engaging holes 31 is not particularly limited, seven engaging holes 31 are provided in the example illustrated in FIG. 3. As long as the engaging holes 31 are provided with openings on the back side of the attachment surface of the housing 11, the engaging holes 31 may or may not penetrate the housing 11.

The liquid discharge head 1 is further provided with convex portions 32 to be connected to the openings of the tanks which engages with the engaging holes 31. The convex portions 32 include flow paths (not illustrated) for supplying the liquid to the recording element substrate 14 illustrated in FIGS. 1 and 2. The convex portions 32 are provided with filters 33 for removing foreign substances in the liquid. The sizes of the convex portions 32 are determined according to the sizes of the openings of the tanks engaged with the engaging holes 31. According to the present example embodiment, four thin convex portions 32, one thick convex portion 32, and one thin convex portion 32 are sequentially formed from left to right as illustrated in FIG. 3. A tank having a large opening is connected to the thick convex portion 32, and a tank having a small opening is connected to each of the thin convex portions 32. Each of the tanks having a small opening is engaged with the liquid discharge head 1 by using one engaging hole 31, and the tank having a large opening is engaged with the liquid discharge head 1 by using two engaging holes 31. Therefore, according to the present example embodiment, up to six tanks can be mounted on the liquid discharge head 1. However, the number of mountable tanks is not limited to six and can be suitably changed.

Although, in the above example, the positioning bosses 21 are formed above the two engaging holes 31 at both ends in the X direction out of a plurality of the engaging holes 31, the positioning bosses 21 may be formed above the engaging holes 31 more on the inner side than the two engaging holes 31 at both ends in the X direction.

(2. Method for Attaching Liquid Discharge Head to Carriage)

Figure 4:
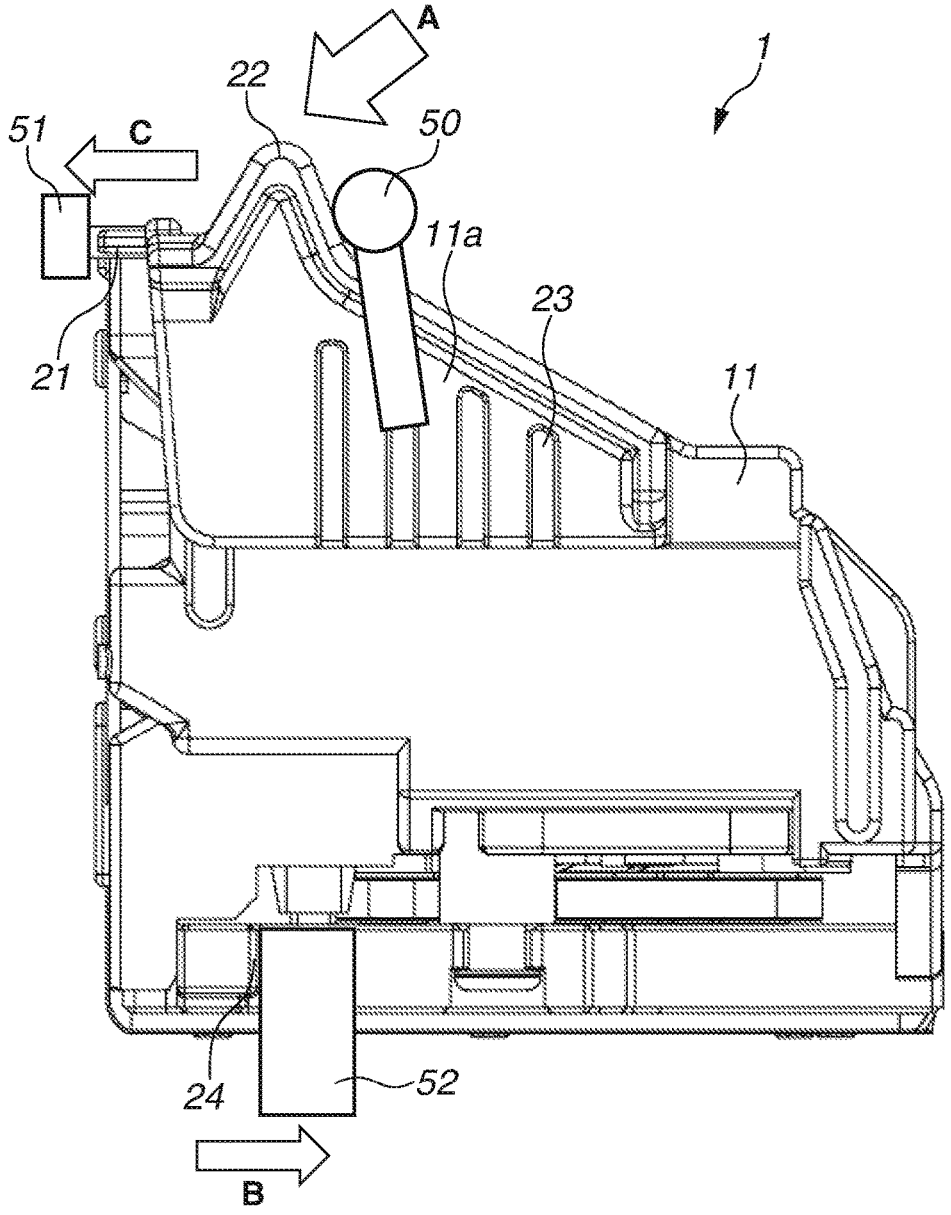
FIG. 4 illustrates a method for attaching the liquid discharge head to the carriage.

FIG. 4 illustrates a side face of the liquid discharge head 1 to describe a method for attaching the liquid discharge head 1 to the carriage.

When attaching the liquid discharge head 1 to the carriage, a user raises a lever 50 provided on the carriage and then inserts the liquid discharge head 1 between the carriage body and the lever 50. In this case, the user makes the positioning boss 21 of the housing 11 face a positioning portion 51 formed on the carriage, and makes a positioning surface 24 of the housing 11 face a positioning portion 52 formed on the carriage. The positioning portion 52 has a function of regulating the amount of contact which is the engagement allowance on the carriage of the liquid discharge head 1. When the user lowers the lever 50 in a state where the liquid discharge head 1 is inserted, the lever 50 contacts the rib 22 formed on the upper side of the side wall 11*a* of the housing 11 to press the rib 22 from obliquely above, as indicated by the arrow A illustrated in FIG. 4. Thus, the liquid discharge head 1 is pressed onto the carriage substrate with the corresponding positioning surface 24 as a fulcrum. In this case, a force is applied on the positioning portion 52 formed on the carriage in the direction indicated by the arrow B.

The lever 50 slides on the rib 22 while pressing it, and the convex portion formed on the lever 50 is fixed to the concave portion 23. The lever 50 is connected with a spring which contracts when brought into contact with the rib 22. When the lever 50 is fixed, a force is applied in the direction indicated by the arrow C illustrated in FIG. 4 in such a way that the liquid discharge head 1 is pressed toward the side of the carriage substrate.

At this time, the contact pads 12*a* illustrated in FIG. 1 fit into the contact pins formed on the carriage. In this case, the total value of elastic forces of the contact pins is set to a value equal to or smaller than a force for fixing the lever 50 to the liquid discharge head 1. Thus, the liquid discharge head 1 is fixed to the carriage. In this fixed state, the orientation and position of the liquid discharge head 1 are determined, and the carriage and the electric connection substrate 12 are electrically connected.

(3. Positioning Method)

If the positioning surface 24 of the liquid discharge head 1 is not correctly in contact with the corresponding positioning portion 52 of the carriage, the orientation of the nozzle array of the liquid discharge head 1 inclines relatively to the rail of the liquid discharge apparatus, and the liquid impact position may possibly shift from the correct position on a recording medium. In this case, a problem of degradation in the printing quality of the recorded image arises.

(When Positioning of Conventional Liquid Discharge Head is not Correctly Performed)

In a conventional liquid discharge apparatus, the carriage and housing are generally made of a resin and the electric wiring substrate is made of a material having higher rigidity than the materials of the carriage and housing. The electric wiring substrate is made of alumina (aluminum oxide) or a highly rigid resin.

For example, suppose right and left positioning bosses are different in size, that is, the right positioning boss is larger than the left positioning boss. In this case, in the fixing operation, the right positioning boss comes into contact with the corresponding positioning portion of the carriage before the left positioning boss. At this time, the housing rotates around the right positioning boss which is previously brought in contact with the corresponding positioning portion of the carriage, as a fulcrum, and the left positioning surface comes into contact with the corresponding positioning portion of the carriage before the right positioning surface. In this case, the reactive force of the resin forming the carriage will restore the orientation of the housing 11 to the original one. However, since the housing 11 is highly rigid and the housing 11 and the electric wiring substrate are fixed with screws, the orientation of the housing 11 is maintained, and the right positioning portion cannot contact the positioning surface of the housing 11. In this case, the orientation of the nozzle array of the liquid discharge head 1 inclines relatively to the rail of the liquid discharge apparatus, so that the liquid impact position on the recording medium may shift from the correct position.

(When Positioning of Liquid Discharge Head 1 According to Present Example Embodiment is not Correctly Performed)

Similar to the above description, the right and left positioning bosses 21 are different in size, that is, the right positioning boss 21 is larger in size than the left positioning boss 21. In this case, the right positioning boss 21 comes into contact with the corresponding positioning portion 51 of the carriage before the left positioning boss 21. At this time, the housing 11 rotates around the right positioning boss 21 which is previously brought in contact with the corresponding positioning portion 51 of the carriage as a fulcrum, and the left positioning surface 24 comes into contact with the corresponding positioning portion 52 of the carriage before the right positioning surface 24. In this case, the reactive force of the resin forming the carriage will restore the orientation of the housing to the original one.

Since in the liquid discharge head 1, the positioning bosses 21 is provided above the engaging holes 31 of the tanks, portions of the housing 11 near the positioning bosses 21 are easily degraded in rigidity and deformed. Therefore, when the right rib 22 is pressed by the lever 50, the housing 11 deforms in the X and Z directions in such a way that the corresponding positioning boss 21 dents with the right rib 22 as a fulcrum.

Figure 5A:
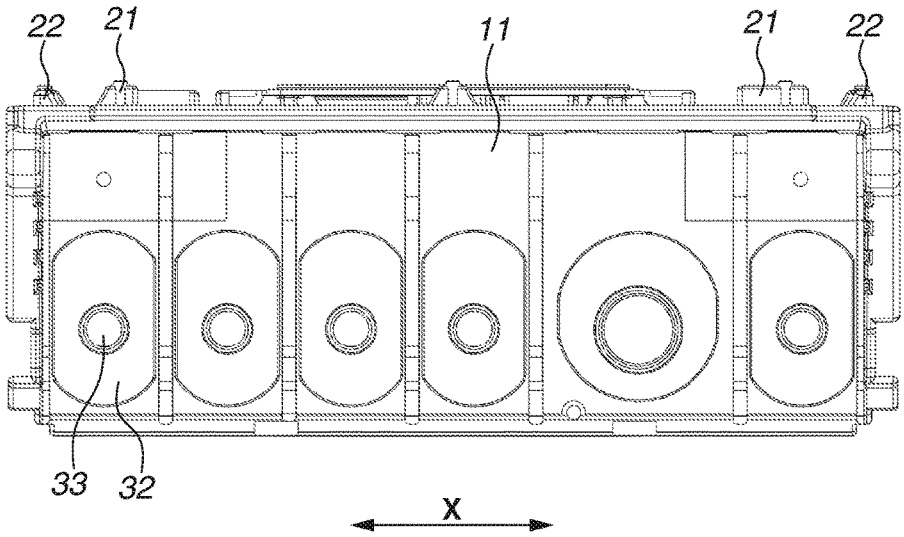
FIGS. 5A and 5B are top views illustrating a deformed state and a non-deformed state of the liquid discharge head according to an example embodiment of the disclosure, respectively.
Figure 5B:
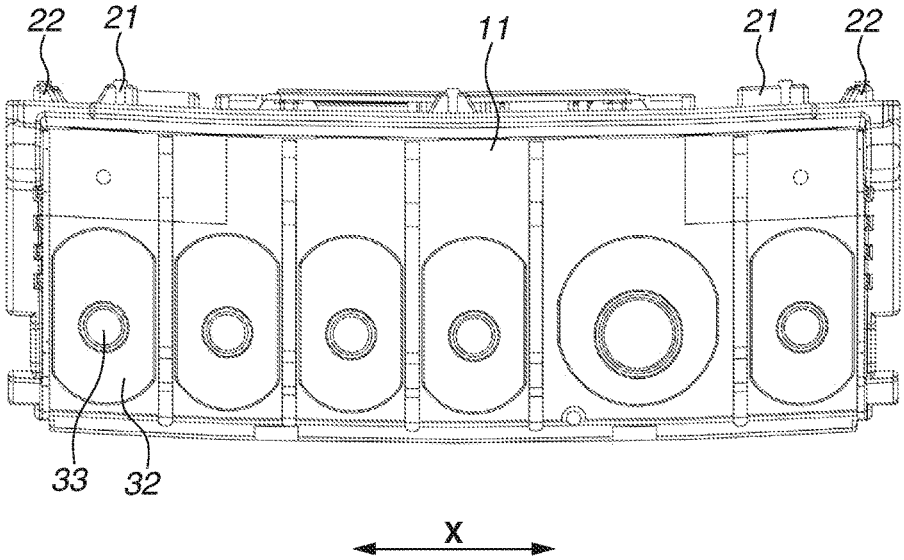

FIG. 5A is a top view illustrating the housing 11 in a non-deformed state. FIG. 5B is a top view illustrating the housing 11 in a deformed state. As illustrated in FIG. 5B, when the housing 11 is deformed in such a way that the corresponding positioning boss 21 dents with the right rib 22 as a fulcrum, the shape of the housing 11 follows the shape of the carriage. As a result, the right positioning portion 52 of the carriage comes into contact with the corresponding positioning surface 24 of the housing 11. In this case, in order to enable sufficient deformation of the housing 11, it is desirable that the length of the engaging holes 31 juxtaposed in the X direction is at least twice the length thereof in the Z direction perpendicular to the X direction when viewed from the backside of the attachment surface.

As described above, according to the present example embodiment, since the positioning bosses 21 are formed above the engaging holes 31 of the housing 11, the housing 11 can be easily deformed. Therefore, the shape of the housing 11 of the liquid discharge head 1 can follow the shape of the carriage, making it easier to fix the liquid discharge head 1 at the correct position.

It is desirable that the positioning bosses 21 are formed above the engaging holes 31 and on the side of the center of the housing 11 rather than the centers of the engaging holes 31. In this case, even when the positioning bosses 21 are formed near the ribs 22 having high rigidity, low rigidity portions formed of the engaging holes 31 between the positioning bosses 21 and the ribs 22 can be enlarged. Therefore, it is possible to make the housing 11 that can be more easily deformed.

In the above-described example embodiment, the illustrated configuration is to be considered as an example and the disclosure is not limited thereto.

According to the disclosure, the two first abutting portions configured to contact the carriage to determine the position of the liquid discharge head 1 on the carriage are formed above the two engaging holes 31 on the outermost sides, or above the engaging holes 31 more on the inner side than the engaging holes 31. Therefore, portions of the housing 11 near the first abutting portions are easily degraded in rigidity and deformed. Therefore, the shape of the housing 11 can follow the shape of the carriage when the first abutting portions contact the carriage, and the liquid discharge head 1 can be more easily fixed to the carriage.

While the disclosure has been described with reference to example embodiments, it is to be understood that the invention is not limited to the disclosed example embodiments. The scope of the following claims is to be accorded the broadest interpretation so as to encompass all such modifications and equivalent structures and functions.

This application claims the benefit of Japanese Patent Application No. 2016-148634, filed Jul. 28, 2016, which is hereby incorporated by reference herein in its entirety.

What is claimed is:

1. A liquid discharge head having a recording element substrate for discharging a liquid and a housing with the recording element substrate attached thereto, which is attached to a carriage of a liquid discharge apparatus, the liquid discharge head comprising:

a plurality of holes having openings on a back side of an attachment surface of the housing to be attached to the carriage, juxtaposed in a direction intersecting with a vertical direction in a state where the liquid discharge head is attached to the carriage; and two first abutting portions, on the attachment surface, formed above two holes at both end sides of a plurality of the juxtaposed holes in the attachment state, or above portions more on an inner side than the two holes in the intersecting direction in the attachment state, and configured to contact the carriage to determine a position of the liquid discharge head on the carriage.

2. The liquid discharge head according to claim 1, wherein the housing further comprises pressed portions with which pressing members for pressing the liquid discharge head onto the carriage come into contact, wherein the pressed portions are formed more on an outer side than the first abutting portions in the intersecting direction, and wherein the first abutting portions are formed above the two holes in the attachment state and more on the inner side than centers of the holes in the intersecting direction.

3. The liquid discharge head according to claim 1, wherein the housing has two second abutting portions formed across the recording element substrate, and configured to contact the carriage to determine the position of the liquid discharge head on the carriage, and wherein the second abutting portions are formed below the first abutting portions in the attachment state.

4. The liquid discharge head according to claim 3, wherein the second abutting portions are formed more on the inner side than the first abutting portions in the intersecting direction.

5. The liquid discharge head according to claim 1, wherein the holes are engaging holes for attaching tanks for storing the liquid to be discharged from the recording element substrate.

6. The liquid discharge head according to claim 1, wherein the housing has a length in the intersecting direction which is at least twice a length in the vertical direction.

7. The liquid discharge head according to claim 1, wherein the housing is formed of a resin with filler of 30 percent or more added.

* * * * *